US010187942B2

(12) United States Patent
van de Ven et al.

(10) Patent No.: US 10,187,942 B2
(45) Date of Patent: Jan. 22, 2019

(54) METHODS AND CIRCUITS FOR CONTROLLING LIGHTING CHARACTERISTICS OF SOLID STATE LIGHTING DEVICES AND LIGHTING APPARATUS INCORPORATING SUCH METHODS AND/OR CIRCUITS

(75) Inventors: Antony P. van de Ven, Sai Kung (HK); Joseph Paul Chobot, Morrisville, NC (US)

(73) Assignee: Cree, Inc., Durham, NC (US)

( * ) Notice: Subject to any disclaimer, the term of this patent is extended or adjusted under 35 U.S.C. 154(b) by 1774 days.

(21) Appl. No.: 13/416,613

(22) Filed: Mar. 9, 2012

(65) Prior Publication Data

US 2013/0162151 A1 Jun. 27, 2013

(51) Int. Cl.
*H05B 33/08* (2006.01)
*H05B 37/02* (2006.01)

(52) U.S. Cl.
CPC ..... *H05B 33/083* (2013.01); *H05B 33/0848* (2013.01); *H05B 33/0863* (2013.01)

(58) Field of Classification Search
CPC .... H05B 37/02; H05B 33/08; H05B 33/0803; H05B 33/083; H05B 33/0848; H05B 33/0863; H05B 33/0866
USPC ... 315/149, 159, 185 R, 192, 193, 224, 291, 315/307, 308, 312; 362/234, 253, 800, 362/276, 227; 257/226, 216, 205, 214 C, 257/214 AL
See application file for complete search history.

(56) References Cited

U.S. PATENT DOCUMENTS

| | | | | |
|---|---|---|---|---|
| 7,213,940 | B1 | 5/2007 | Van De Ven et al. | |
| 7,675,248 | B2 * | 3/2010 | Mubaslat et al. | 315/308 |
| 7,687,940 | B2 | 3/2010 | Mosebrook et al. | |
| 7,821,194 | B2 | 10/2010 | Negley et al. | |
| 7,967,652 | B2 | 6/2011 | Emerson et al. | |
| 2006/0237636 | A1 * | 10/2006 | Lyons et al. | 250/228 |
| 2007/0115228 | A1 | 5/2007 | Roberts et al. | |
| 2007/0115662 | A1 | 5/2007 | Roberts et al. | |
| 2008/0094000 | A1 * | 4/2008 | Yamamoto et al. | 315/250 |
| 2009/0160363 | A1 | 6/2009 | Negley et al. | |
| 2009/0184616 | A1 | 7/2009 | Van De Ven et al. | |
| 2009/0218960 | A1 * | 9/2009 | Lyons et al. | 315/297 |

(Continued)

FOREIGN PATENT DOCUMENTS

| | | | |
|---|---|---|---|
| WO | WO 03/015067 | A1 | 2/2003 |
| WO | WO 2004/100613 | A1 | 11/2004 |

(Continued)

OTHER PUBLICATIONS

International Search Report Corresponding to International Application No. PCT/US2012/070897; dated Mar. 1, 2013; 10 Pages.

(Continued)

*Primary Examiner* — Thai Pham
(74) *Attorney, Agent, or Firm* — Myers Bigel, P.A.

(57) ABSTRACT

A method of controlling a solid state lighting apparatus can be provided by receiving a solid state lighting characteristic selection signal at a solid state lighting apparatus and selecting, responsive to the solid state lighting characteristic selection signal, a solid state lighting model that defines a relationship between different lighting parameters used to vary light output from the solid state lighting apparatus responsive to a user input provided to the solid state lighting apparatus.

40 Claims, 7 Drawing Sheets

(56) References Cited

U.S. PATENT DOCUMENTS

| | | | |
|---|---|---|---|
| 2010/0110671 | A1 | 5/2010 | Gordin et al. |
| 2010/0259182 | A1 | 10/2010 | Man et al. |
| 2011/0068696 | A1 | 3/2011 | Van De Ven et al. |
| 2011/0068701 | A1 | 3/2011 | Van De Ven et al. |
| 2011/0068702 | A1 | 3/2011 | Van De Ven et al. |
| 2011/0175527 | A1 | 7/2011 | Ramer et al. |
| 2012/0104953 | A1 | 5/2012 | Chobot et al. |
| 2012/0153844 | A1 | 6/2012 | Chobot et al. |

FOREIGN PATENT DOCUMENTS

| | | | |
|---|---|---|---|
| WO | WO 2008/142622 | A1 | 11/2008 |
| WO | WO 2011/083117 | A2 | 7/2011 |

OTHER PUBLICATIONS

International Preliminary Report on Patentability and Written Opinion Corresponding to International Application No. PCT/US2012/070897; dated Jul. 3, 2014; 9 Pages.

European Search Report Corresponding to European Patent Application No. 12 86 0560; dated Apr. 29, 2016; 7 Pages.

* cited by examiner

METHODS AND CIRCUITS FOR CONTROLLING LIGHTING CHARACTERISTICS OF SOLID STATE LIGHTING DEVICES AND LIGHTING APPARATUS INCORPORATING SUCH METHODS AND/OR CIRCUITS

CLAIM OF PRIORITY

The present application claims priority from U.S. Provisional Patent Application Ser. No. 61/579,986, filed Dec. 23, 2011, the disclosure of which is hereby incorporated by reference herein in its entirety.

FIELD OF THE INVENTION

The present invention relates to solid state lighting, and more particularly to solid state lighting systems including a plurality of solid state lighting devices and methods of operating solid state lighting systems including a plurality of solid state lighting devices.

BACKGROUND

Solid state lighting arrays are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region.

Solid state lighting panels are commonly used as backlights for small liquid crystal display (LCD) screens, such as LCD display screens used in portable electronic devices. In addition, there has been increased interest in the use of solid state lighting panels as backlights for larger displays, such as LCD television displays.

For smaller LCD screens, backlight assemblies typically employ white LED lighting devices that include a blue-emitting LED coated with a wavelength conversion phosphor that converts some of the blue light emitted by the LED into yellow light. The resulting light, which is a combination of blue light and yellow light, may appear white to an observer. However, while light generated by such an arrangement may appear white, objects illuminated by such light may not appear to have a natural coloring, because of the limited spectrum of the light. For example, because the light may have little energy in the red portion of the visible spectrum, red colors in an object may not be illuminated well by such light. As a result, the object may appear to have an unnatural coloring when viewed under such a light source.

Visible light may include light having many different wavelengths. The apparent color of visible light can be illustrated with reference to a two dimensional chromaticity diagram, such as the 1931 International Conference on Illumination (CIE) Chromaticity Diagram illustrated in FIG. 8, and the 1976 CIE u'v' Chromaticity Diagram, which is similar to the 1931 Diagram but is modified such that similar distances on the 1976 u'v' CIE Chromaticity Diagram represent similar perceived differences in color. These diagrams provide useful reference for defining colors as weighted sums of colors.

In a CIE-u'v' chromaticity diagram, such as the 1976 CIE Chromaticity Diagram, chromaticity values are plotted using scaled u- and v-parameters which take into account differences in human visual perception. That is, the human visual system is more responsive to certain wavelengths than others. For example, the human visual system is more responsive to green light than red light. The 1976 CIE-u'v' Chromaticity Diagram is scaled such that the mathematical distance from one chromaticity point to another chromaticity point on the diagram is proportional to the difference in color perceived by a human observer between the two chromaticity points. A chromaticity diagram in which the mathematical distance from one chromaticity point to another chromaticity point on the diagram is proportional to the difference in color perceived by a human observer between the two chromaticity points may be referred to as a perceptual chromaticity space. In contrast, in a non-perceptual chromaticity diagram, such as the 1931 CIE Chromaticity Diagram, two colors that are not distinguishably different may be located farther apart on the graph than two colors that are distinguishably different.

As shown in FIG. 8, colors on a 1931 CIE Chromaticity Diagram are defined by x and y coordinates (i.e., chromaticity coordinates, or color points) that fall within a generally U-shaped area. Colors on or near the outside of the area are saturated colors composed of light having a single wavelength, or a very small wavelength distribution. Colors on the interior of the area are unsaturated colors that are composed of a mixture of different wavelengths. White light, which can be a mixture of many different wavelengths, is generally found near the middle of the diagram, in the region labeled 100 in FIG. 8. There are many different hues of light that may be considered "white," as evidenced by the size of the region 100. For example, some "white" light, such as light generated by sodium vapor lighting devices, may appear yellowish in color, while other "white" light, such as light generated by some fluorescent lighting devices, may appear more bluish in color.

Light that generally appears green is plotted in the regions 101, 102 and 103 that are above the white region 100, while light below the white region 100 generally appears pink, purple or magenta. For example, light plotted in regions 104 and 105 of FIG. 8 generally appears magenta (i.e., red-purple or purplish red).

It is further known that a binary combination of light from two different light sources may appear to have a different color than either of the two constituent colors. The color of the combined light may depend on the relative intensities of the two light sources. For example, light emitted by a combination of a blue source and a red source may appear purple or magenta to an observer. Similarly, light emitted by a combination of a blue source and a yellow source may appear white to an observer.

Also illustrated in FIG. 8 is the planckian locus 106, which corresponds to the location of color points of light emitted by a black-body radiator that is heated to various temperatures. In particular, FIG. 8 includes temperature listings along the black-body locus. These temperature listings show the color path of light emitted by a black-body radiator that is heated to such temperatures. As a heated object becomes incandescent, it first glows reddish, then yellowish, then white, and finally bluish, as the wavelength associated with the peak radiation of the black-body radiator becomes progressively shorter with increased temperature, Illuminants which produce light which is on or near the black-body locus can thus be described in terms of their correlated color temperature (CCT).

The chromaticity of a particular light source may be referred to as the "color point" of the source. For a white light source, the chromaticity may be referred to as the "white point" of the source. As noted above, the white point of a white light source may fall along the planckian locus. Accordingly, a white point may be identified by a correlated color temperature (CCT) of the light source. White light typically has a CCT of between about 2000 K and 8000 K. White light with a CCT of 4000 may appear yellowish in color, while light with a CCT of 8000 K may appear more bluish in color. Color coordinates that lie on or near the black-body locus at a color temperature between about 2500 K and 6000 K may yield pleasing white light to a human observer.

"White" light also includes light that is near, but not directly on the planckian locus. A Macadam ellipse can be used on a 1931 CIE Chromaticity Diagram to identify color points that are so closely related that they appear the same, or substantially similar, to a human observer. A Macadam ellipse is a closed region around a center point in a two-dimensional chromaticity space, such as the 1931 CIE Chromaticity Diagram, that encompasses all points that are visually indistinguishable from the center point. A seven-step Macadam ellipse captures points that are indistinguishable to an ordinary observer within seven standard deviations, a ten step Macadam ellipse captures points that are indistinguishable to an ordinary observer within ten standard deviations, and so on. Accordingly, light having a color point that is within about a ten step Macadam ellipse of a point on the planckian locus may be considered to have the same color as the point on the planckian locus.

The ability of a light source to accurately reproduce color in illuminated objects is typically characterized using the color rendering index (CRI). In particular, CRI is a relative measurement of how the color rendering properties of an illumination system compare to those of a black-body radiator. The CRI equals 100 if the color coordinates of a set of test colors being illuminated by the illumination system are the same as the coordinates of the same test colors being irradiated by the black-body radiator. Daylight has the highest CRI (of 100), with incandescent bulbs being relatively close (about 95), and fluorescent lighting being less accurate (70-85).

For large-scale backlight and illumination applications, it is often desirable to provide a lighting source that generates a white light having a high color rendering index, so that objects and/or display screens illuminated by the lighting panel may appear more natural. Accordingly, to improve CRI, red light may be added to the white light, for example, by adding red emitting phosphor and/or red emitting devices to the apparatus. Other lighting sources may include red, green and blue light emitting devices. When red, green and blue light emitting devices are energized simultaneously, the resulting combined light may appear white, or nearly white, depending on the relative intensities of the red, green and blue sources.

One difficulty with solid state lighting systems including multiple solid state devices is that the manufacturing process for LEDs typically results in variations between individual LEDs. This variation is typically accounted for by binning, or grouping, the LEDs based on brightness, and/or color point, and selecting only LEDs having predetermined characteristics for inclusion in a solid state lighting system. LED lighting devices may utilize one bin of LEDs, or combine matched sets of LEDs from different bins, to achieve repeatable color points for the combined output of the LEDs. Even with binning, however, LED lighting systems may still experience significant variation in color point from one system to the next.

One technique to tune the color point of a lighting fixture, and thereby utilize a wider variety of LED bins, is described in commonly assigned United States Patent Publication No. 2009/0160363, the disclosure of which is incorporated herein by reference. The '363 application describes a system in which phosphor converted LEDs and red LEDs are combined to provide white light. The ratio of the various mixed colors of the LEDs is set at the time of manufacture by measuring the output of the light and then adjusting string currents to reach a desired color point. The current levels that achieve the desired color point are then fixed for the particular lighting device, LED lighting systems employing feedback to obtain a desired color point are described in U.S. Publication No. 2007/0115662 and 2007/0115228 and the disclosures of which are incorporated herein by reference.

SUMMARY

Some embodiments according to the invention can provide methods of controlling a solid state lighting apparatus by receiving a solid state lighting characteristic selection signal at a solid state lighting apparatus and selecting, responsive to the solid state lighting characteristic selection signal, a solid state lighting model that defines a relationship between different lighting parameters used to vary light output from the solid state lighting apparatus responsive to a user input provided to the solid state lighting apparatus.

In some embodiments according to the invention, receiving a solid state lighting characteristic selection signal at a solid state lighting apparatus can be provided by receiving the solid state lighting characteristic selection signal at the solid state lighting apparatus separate from the user input. In some embodiments according to the invention, the user input can be user input from a solid state lighting switch. In some embodiments according to the invention, the user input can be a dimming indication configured to control dimming of the light output from the solid state lighting apparatus.

In some embodiments according to the invention, selecting a solid state lighting model can be provided by selecting among a plurality of predefined solid state lighting models each corresponding to a respective value of the solid state lighting characteristic selection signal. In some embodiments according to the invention, the plurality of predefined solid state lighting models are configured to vary the light output from the solid state lighting apparatus differently in response to identical user input to the solid state lighting apparatus.

In some embodiments according to the invention, the method can further include receiving a compensation signal, at the solid state lighting apparatus, that is configured to reduce variation in the light output from the solid state lighting apparatus associated with variation in light emitted from different light emitting diodes included in the solid state lighting apparatus. In some embodiments according to the invention, the method can further include receiving the compensation signal at the solid state lighting apparatus separately from the solid state lighting characteristic selection signal.

In some embodiments according to the invention, receiving a compensation signal at the solid state lighting apparatus can be provided by receiving a combined signal including the compensation signal and the solid state lighting characteristic selection signal at solid state lighting apparatus.

In some embodiments according to the invention, receiving a solid state lighting characteristic selection signal at a solid state lighting apparatus can be provided by receiving the solid state lighting characteristic selection signal from a circuit that is local to the apparatus and is configured during, or prior to, installation of the solid state lighting apparatus. In some embodiments according to the invention, receiving a solid state lighting characteristic selection signal at a solid state lighting apparatus can be provided by receiving the solid state lighting characteristic selection signal from a circuit that is outside the apparatus and is configured to provide the solid state lighting characteristic selection signal during operation of the solid state lighting apparatus.

In some embodiments according to the invention, the solid state lighting model can include a first solid state lighting model, where the solid state lighting characteristic selection signal can be a first value, and the relationship can be a first relationship, where the method can further include selecting, responsive to the solid state lighting characteristic selection signal having a second value, a second solid state lighting model defining a second relationship between the different lighting parameters used to vary the light output from the solid state lighting apparatus responsive to the user input provided to the solid state lighting apparatus. In some embodiments according to the invention, a first lighting parameter of the solid state lighting apparatus can be a dimming value and a second lighting parameter of the solid state lighting apparatus can be a color value.

In some embodiments according to the invention, the color value can be a correlated color temperature value, a color registration index value, a color point value, or a chromaticity value. In some embodiments according to the invention, a third lighting parameter of the solid state lighting apparatus can be a temperature value.

In some embodiments according to the invention, the method can further include providing circuit parameter values, based on the selected solid state lighting model, to provide the light output from the apparatus. In some embodiments according to the invention, the circuit parameter values can be a duty cycle signal to control a shunt level of at least one light emitting diode included in a LED string of the apparatus and a current control signal configured to control current provided to the LED string.

In some embodiments according to the invention, the solid state lighting model is approximated by a plurality of control points of a Bézier surface that provides the duty cycle signal responsive to the current. In some embodiments according to the invention, receiving a solid state lighting characteristic selection signal at a solid state lighting apparatus can be provided by receiving the solid state lighting characteristic selection signal from a circuit including a resistor, a capacitor, and/or an inductor.

In some embodiments according to the invention, a solid state lighting apparatus can include a light emitting diode (LED) string that includes a plurality of LEDs, where the LED string configured to emit light responsive to current provided to the LEDs. A solid state lighting characteristic selection circuit can be configured to provide a solid state lighting characteristic selection signal and a solid state lighting controller circuit, can be coupled to the LED string and to the solid state lighting characteristic selection circuit, configured to select a solid state lighting model responsive to the solid state lighting characteristic selection signal input to the controller circuit, the model configured to define a relationship between different lighting parameters used to vary the light emitted from the LED string responsive to a user input to the controller circuit.

DETAILED DESCRIPTION OF EMBODIMENTS ACCORDING TO THE INVENTION

Figure 1:
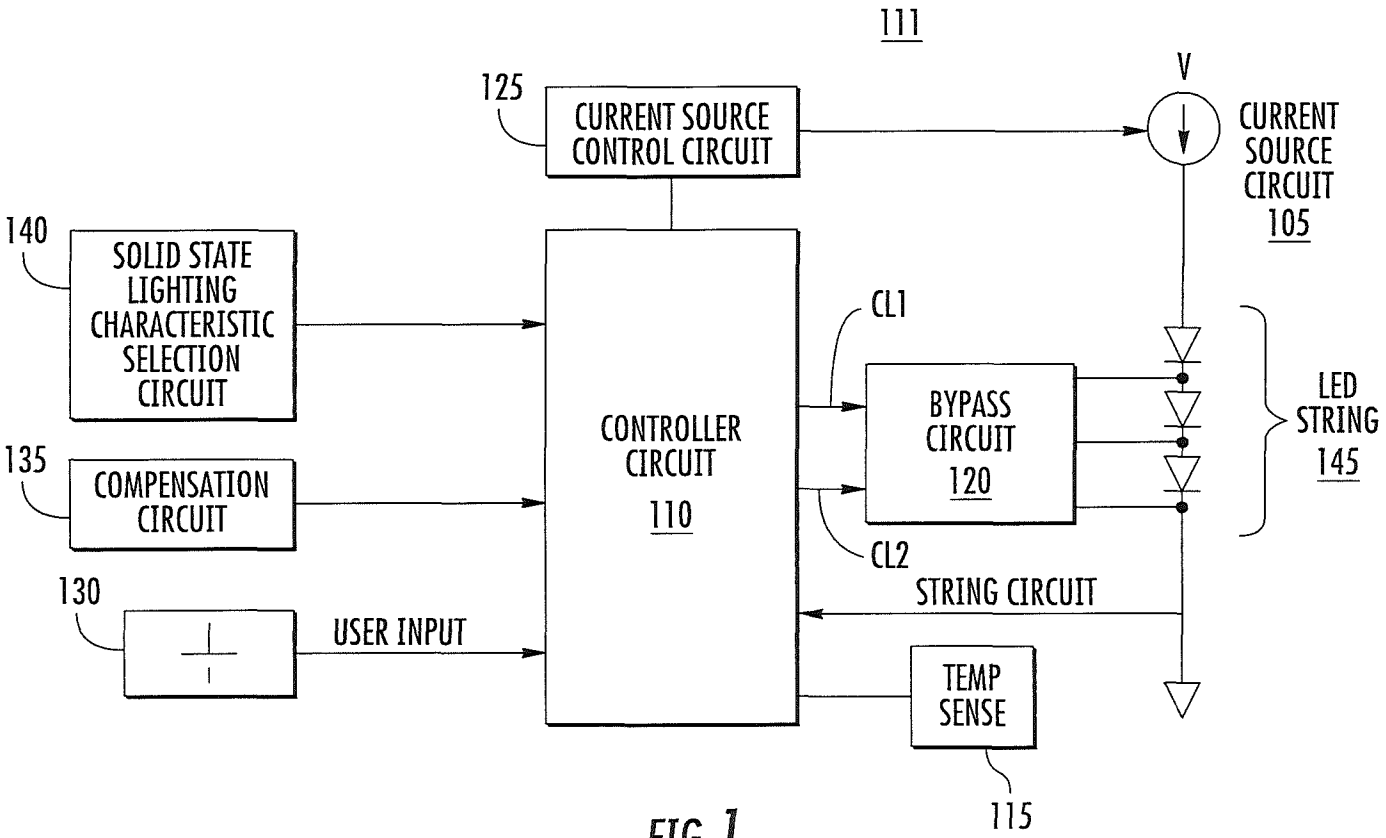
FIG. 1 is a block diagram illustrating a solid state lighting apparatus in some embodiments according to the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

As described herein, a solid lighting characteristic selection signal can be used to select a solid state lighting model defining a relationship between different lighting parameters used to vary light output from the solid state lighting apparatus responsive to a user input to the apparatus. For example, in some embodiments according to the invention, the solid lighting characteristic selection signal (sometimes referred to herein the selection signal) has a value corresponding to a model that controls the color of light provided by the apparatus to follow the plankian locus as the intensity of the light varies (sometimes referred to incandescent style dimming).

It will be understood that the term "lighting parameter" includes any indication used to specify the intensity and/or color of light emitted from the solid state lighting apparatus. For example, in some embodiments according to the invention, the lighting parameter can indicate the intensity of the light to be emitted, which can be a constant or variable value. In some embodiments according to the invention, the lighting parameter can indicate the color of the light to be emitted, which can be a constant or variable value. Other lighting parameters can also be used.

It will be understood that the apparatus can support any number of predefined models, one of which can, in turn, be selected by making the selection signal have a value that corresponds to the desired predefined solid state lighting model to be put into operation by the apparatus. Therefore, in some embodiments according to the invention, a large number of lighting characteristics can be supported by the apparatus so that a wide variety of user preferences can be accommodated. For example, during manufacturing of the apparatus, a solid state lighting characteristic selection signal circuit can be configured to provide the selection signal which corresponds to the desired predefined solid state lighting model to be provided when the apparatus is installed and operational.

It will be understood that the solid state lighting characteristic selection signal may be separate from the user input to the apparatus which is used to, for example, adjust the dimming of the apparatus. For example, once defined, the solid state lighting characteristic selection signal can select the predefined model which is used to provide the different circuit parameters in response to when the user adjusts the dimming of the apparatus.

In this way, different apparatus can be configured differently during manufacturing so that apparatus that are otherwise the same, can provide different lighting characteristics even when provided with identical user input. For example, in one configuration, the selection signal can have a value that selects a first predefined solid state lighting model so that incandescent style is provided by the apparatus, whereas when the selection signal has a second value, a second predefined solid state lighting model is selected so that the color of the light from the apparatus remains constant over the entire range of dimming. Therefore, different predefined solid state lighting models can be selected based on the selection signal value to provide different characteristics of lighting according to user preference or specification.

It will also be noted that in some embodiments according to the invention, the apparatus can include a compensation circuit which provides a compensation signal configured to reduce variation in the light output from the solid state lighting apparatus which may be caused by variation in manufacturing processes over different LEDs, especially when the LEDs are included in a string of LEDs in the apparatus. In particular, LEDs that are manufactured to be identical can nonetheless emit slightly different wavelength light such that compensation may be typically provided to reduce the variation which may otherwise produce undesirable artifacts in the light provided by the apparatus. The compensation signal can therefore, adjust the operation of the LEDs in the apparatus so that different ones of the apparatus can provide light which is more or less the same. Compensation for variation in the manufacturing process of LEDs is described further in, for example, U.S. patent application Ser. No. 12/704,730, (filed Feb. 12, 2010), commonly assigned to the assignee of the present application and incorporated herein by reference.

In some embodiments according to the invention, the compensation circuit may be separate from the solid state lighting characteristic selection circuit described herein. In other words, the solid state lighting characteristic selection circuit can be used to provide a signal so that the characteristics of the light output by the apparatus varies according to user preference or specification, whereas the compensation circuit may provide a signal so that the light emitted by the apparatus tends to be substantially equal across multiple ones of the apparatus.

In some embodiments according to the invention, both the compensation signal and the selection signal are provided to the apparatus, so that if the same predefined solid state lighting model is selected in two different apparatus, the compensation signal will help reduce variation between the two different apparatus. It will also be noted that, in some embodiments according to the invention, the compensation circuit and the solid state lighting characteristics selection circuit can be combined so that a combined signal is provided to the apparatus. The combined signal can include a solid state lighting characteristic selection signal component and a compensation component. Otherwise, in some embodiments according to the invention, the selection signal and the compensation signal may be provided separately to the apparatus.

In some embodiments according to the invention, the solid state lighting characteristic selection signal can be provided by a circuit that is local to the apparatus and is configured during, or prior to, installation of the apparatus, such as during the manufacturing process. Therefore, once installed, the apparatus can provide light according to the characteristics selected by the selection signal for the entire time that the apparatus operates. In other embodiments according to the invention, the solid state lighting characteristics selection signal can be provided by a circuit which is remote from (i.e, outside) the apparatus. In such embodiments, the solid state lighting characteristic selection signal may be varied after installation if, for example, the predefined solid state lighting model selected during manufacturing is determined to be inadequate after installation or it is desired that the solid state lighting model should be selected after installation of the apparatus.

IG. 1 is a block diagram that illustrates a solid state lighting apparatus 111 in some embodiments according to the invention. According to FIG. 1, a controller circuit 110 operates responsive to a solid state lighting characteristic selection signal to select among a plurality of predefined solid state lighting models, each of which can define a relationship between different lighting parameters used to vary the light output from the apparatus in response to a user input provided by a remote solid state lighting switch 130.

The switch 130 can be any type of switch that is adequate to vary the dimming value to the apparatus 111. For example, in some embodiments according to the invention, the switch 130 can have a "slider" input that moves in a straight line between the lowest most and the uppermost positions. In some embodiments according to the invention, the input can be a knob that rotate between positions. In some embodiments according to the invention, the dimming indication can be a voltage signal that varies between 0 and 10 volts. Other voltage ranges can also be used. In some embodiments according to the invention, the input can be electronic, rather than mechanical. For example, the input can be compatible with the Digital Addressable Lighting Interface (DALI) protocol, originally part of Europe's Standard 60929, which is a NEMA Standard (243-2004) in the United States.

In operation, the controller circuit 110 can receive the selection signal from a solid state lighting characteristic selection circuit 140 to select one of the plurality of predefined solid state lighting models to provide a selected relationship that will be maintained between different lighting parameters as the user input changes. For example, in some embodiments according to the invention, the selected predefined solid state lighting model may define the relationship between a dimming value and a color value so that the light output from the apparatus 111 follows the plankian 100 as the input from the switch 130 varies. In other embodiments according to the invention, a different value of the selection signal can select a different predefined solid state lighting model so that, for example, the dimming value and the color value are maintained in a different relationship (e.g., constant color dimming) as the user input varies. In other words, as the user input varies the dimming value, the color value may be held constant so that despite the intensity of the light provided by the apparatus 111, the color remains constant. It will understood that other solid state lighting models may be utilized to provide other characteristic type lighting. Lighting parameters other than dimming and color may also be used.

Figure 6:
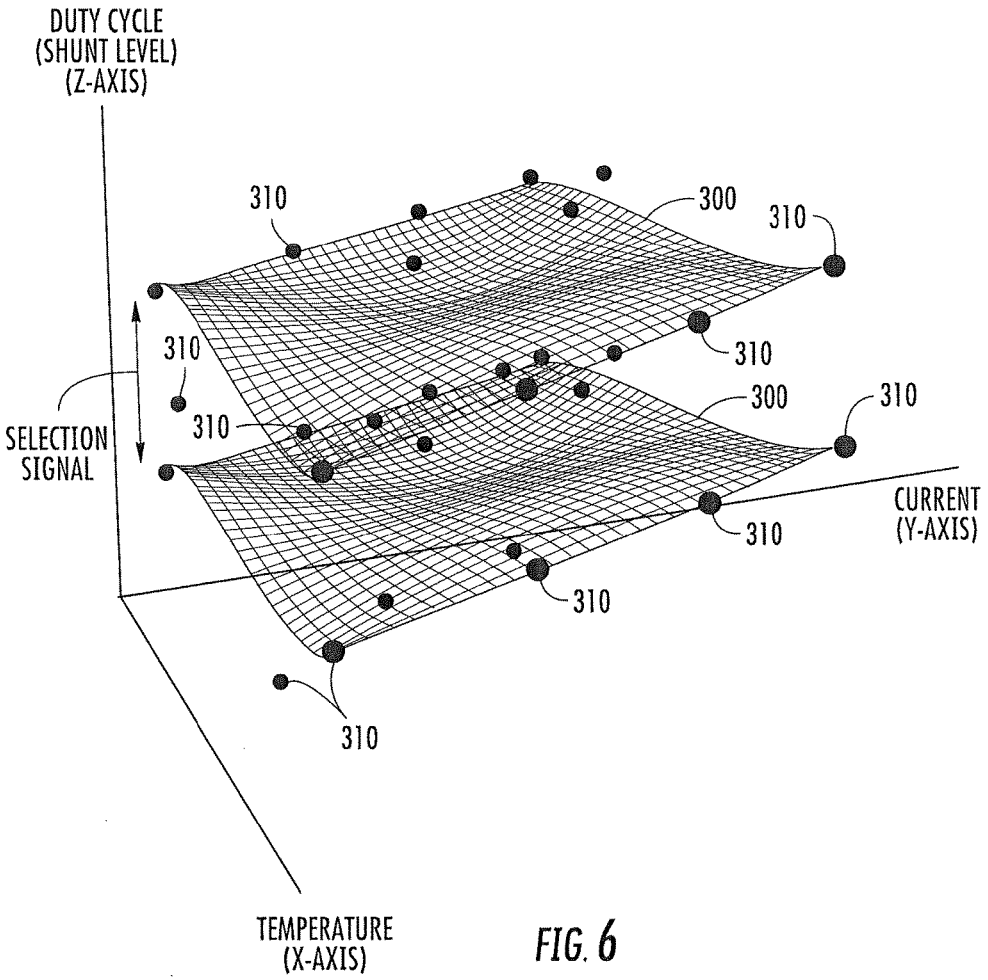
FIGS. 6 and 7 are illustrations of Bezier surfaces representing solid state lighting models as a function of the solid state lighting characteristic selection signal in some embodiments according to the invention.
Figure 7:
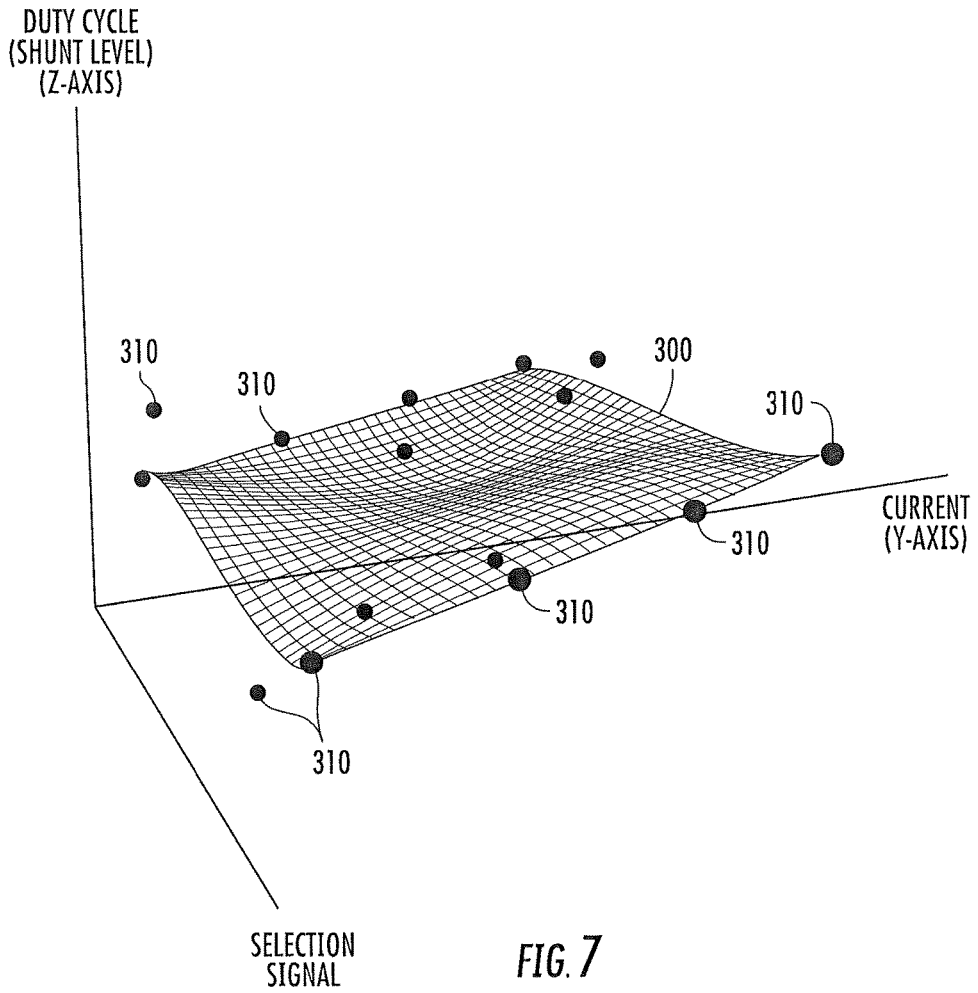
Figure 8:
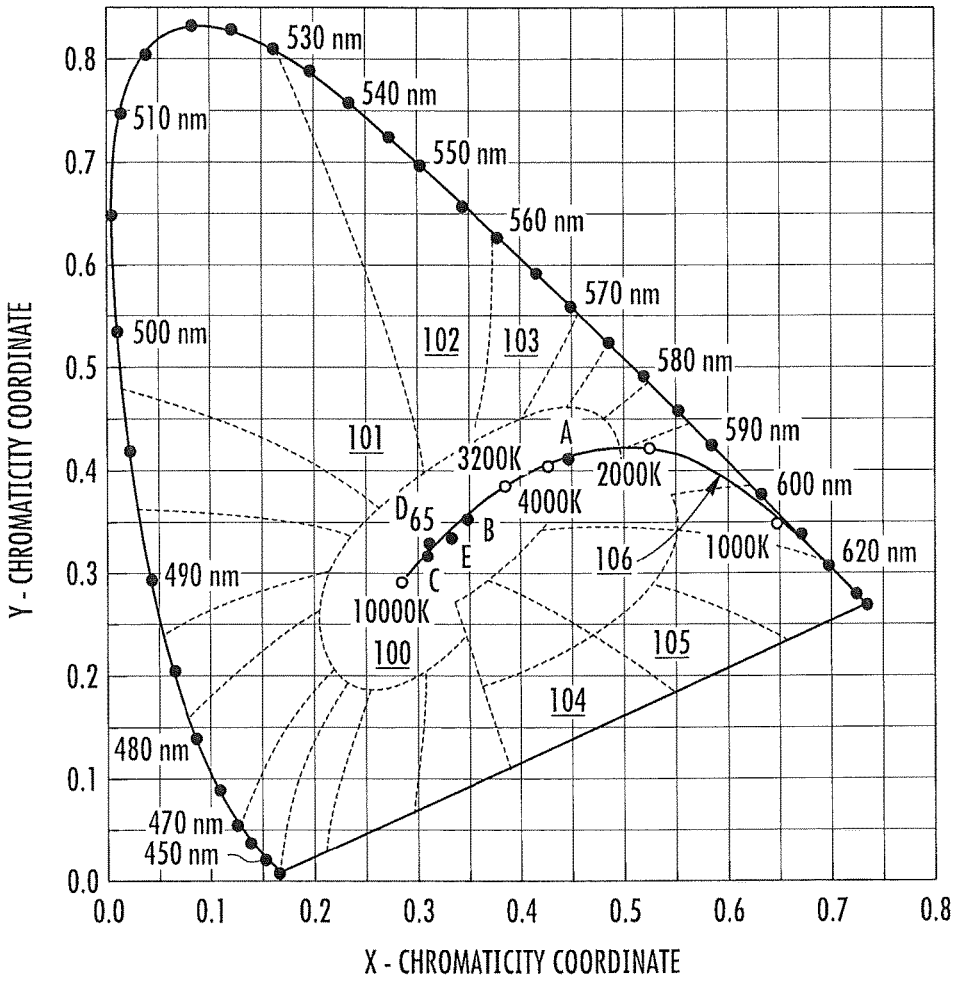
FIG. 8 is a 1931 CIE chromaticity diagram.

It will be understood that the predefined solid state lighting models may be represented as the surfaces shown in FIGS. 6 and 7. According to FIGS. 6 and 7, and as further described herein, the models represented by the surfaces in FIGS. 6 and 7 can relate the different lighting parameters (such as a dimming value and a color value) so that corresponding circuit parameter values are provided by the controller circuit 110 to affect the light emitted by the apparatus 111. Therefore, in operation, the controller circuit 110 can select a model represented by the surfaces shown for example in FIGS. 6 and 7 to relate the different lighting parameters in order to generate values for circuit parameters used to control the apparatus 111 so that the light emitted by the apparatus 111 reflects the lighting parameters.

It will be understood that the solid state lighting characteristic selection signal can be assigned any value (within any range) which is predefined to correspond to a particular predefined solid state lighting model that is accessible to the controller circuit 110. In other words, in some embodiments according to the invention, the selection signal can have any one of N values where each of the discrete values of the selection signal within the N values corresponds to one of the predefined solid state lighting models that may be put into operation by the controller circuit 110. For example the first value of the selection signal can be predefined to correspond to a lighting style that is characterized by an incandescent style of dimming. Another value of the selection signal can be predefined to correspond to another of the predefined solid state lighting models which allows the controller circuit 110 to put into effect the constant color dimming.

The controller circuit 110 can provide circuit parameter values to control an LED string 145 (including a plurality of LEDs) to emit light that is characterized by the different lighting parameters described herein. In particular, the controller circuit 110 uses the selected predefined model to control a current source control circuit 125 to generate a current circuit parameter value (i.e., a current) from a current source circuit 150. The current generated by the current source circuit 150 causes light at a particular intensity to be emitted by the LED string 145 in accordance with the dimming parameter.

The controller circuit 110 also provides duty cycle signals CL1 and CL2, as circuit parameter values, to a bypass circuit 120. The bypass circuit 120 is coupled in parallel with selected ones of the LEDs included in the string 145. The bypass circuit 120 operates in response to the duty cycle signals CL1 and CL2 to selectively bypass the selected ones of the LEDs to cause the LEDs in the string 145 to generate light having a color that is in accordance with the color value lighting parameter.

The controller circuit 110 can also receive a temperature as a circuit parameter value that indicates the temperature in which the apparatus 111 operates. The temperature value can be used by the controller circuit 110 to modify the other circuit parameter values so that the light emitted by the string 145 is maintained in accordance with the lighting parameters.

Still referring to FIG. 1, a compensation signal is provided to the controller circuit 110 by a compensation circuit 135. The compensation signal can be used to compensate for variations in the light emitted by different ones of the LEDs in the string 145. The variations in the light output by the different LEDs may result from differences in the process used to manufacture the LEDs. In particular, some LEDs which are manufactured to be identical may actually emit slightly different frequencies of light due to, for example, differences in the phosphor included in the LED. Accordingly, the compensation signal can be used to take into account the variation between the LEDs when controlling LEDs that do not produce identical light despite identical inputs.

Further, the compensation associated with the variation in the LEDs described above can be taken into account when generating the predefined solid state lighting models that relate the different lighting parameters to one another. In other words, the compensation signal can characterize the differences between the LEDs so that a proper set of predefined solid state lighting models are identified for operation by the controller circuit 110. Still further, the solid state lighting characteristic selection signal can be used to select among those predefined solid state lighting models that are identified by the compensation signal.

Figure 2:
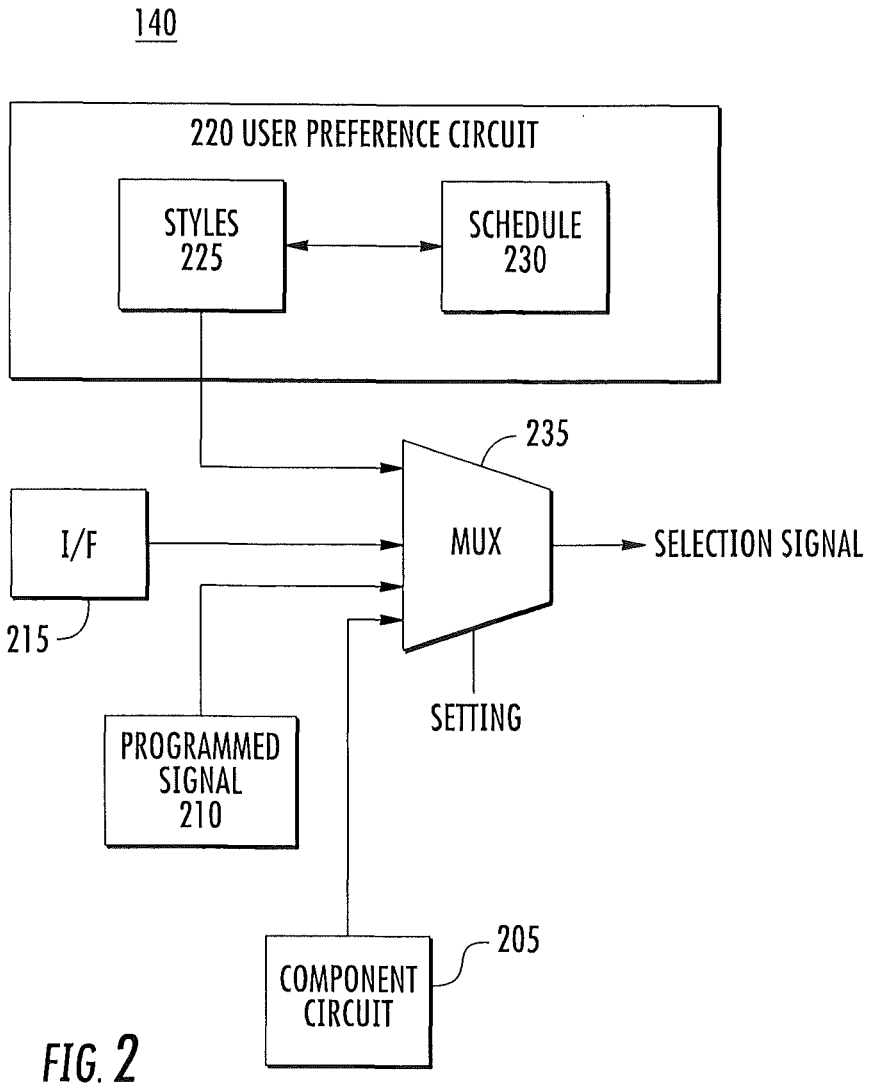
FIG. 2 is a block diagram illustrating a solid state lighting characteristic selection circuit included in the solid state lighting apparatus in some embodiments according to the invention.

FIG. 2 is a block diagram that illustrates the solid state lighting characteristic selection circuit 140 in some embodiments according to the invention. According to FIG. 2, the solid state lighting characteristic selection signal can be provided by a multiplexor circuit 235 to select among a plurality of inputs using a setting that can identify the mode by which the selection signal is to be provided. Each of the inputs to the multiplexor circuit 235 can be provided with a particular type of selection signal, any one of which may be ultimately provided to the controller circuit 110.

Still referring to FIG. 2, one of the inputs of the multiplexor circuit 235 is coupled to a user preference circuit 220 that can store particular styles of solid state lighting characteristics 225, any one of which may be selected by a schedule 230. In operation, the schedule 230 may specify different lighting characteristics that may be used at different times of the day, days of the week etc., which may in turn be provided as the selection signal by the multiplexor circuit 235. Therefore, the user may specify various types of lighting characteristics that can be expressed as corresponding selection signal values which can be provided to the apparatus 111 using the preference circuit 220 to select a predefined model, rather than providing a static selection signal to the controller circuit 110.

A wireless interface circuit 215 can be coupled to another of the inputs to the multiplexor circuit 235 to provide a different version of the selection signal to the controller circuit 110. In particular, a wireless remote control may be utilized to specify a selection signal to the interface circuit 215, which may then be provided as the selection signal to the controller circuit 110. In some embodiments according to the invention, the wireless interface circuit 215 interfaces to a remote control which may be utilized by a user who can specify a particular solid state lighting model to be utilized by the controller circuit 110. Again, the approach taken here may be to provide a variation in the different lighting characteristics provided by the apparatus 111 in accordance with the user's preference after installation of the apparatus 111.

A programmed signal circuit 210 may store different versions of the selection signal which may be accessed and provided to the controller circuit 110 by the multiplexor circuit 235. Accordingly, the selection signal values can be stored within the program signal circuit 210 in advance and configured to provide one of the selection signal values upon installation.

A component circuit 205 can also be coupled to another of the inputs to the multiplexor circuit 235 to provide a type of static selection signal to the controller circuit 110. The component circuits 205 may be passive components that are arranged in, for example, networks to provide various values for the selection signal so that the controller circuit 110 may be controlled to select any of the predefined solid state lighting models accessible thereto. Also, any of the selection circuits shown in FIG. 2 may be used separately and without the multiplexor circuit 235.

Figure 3:
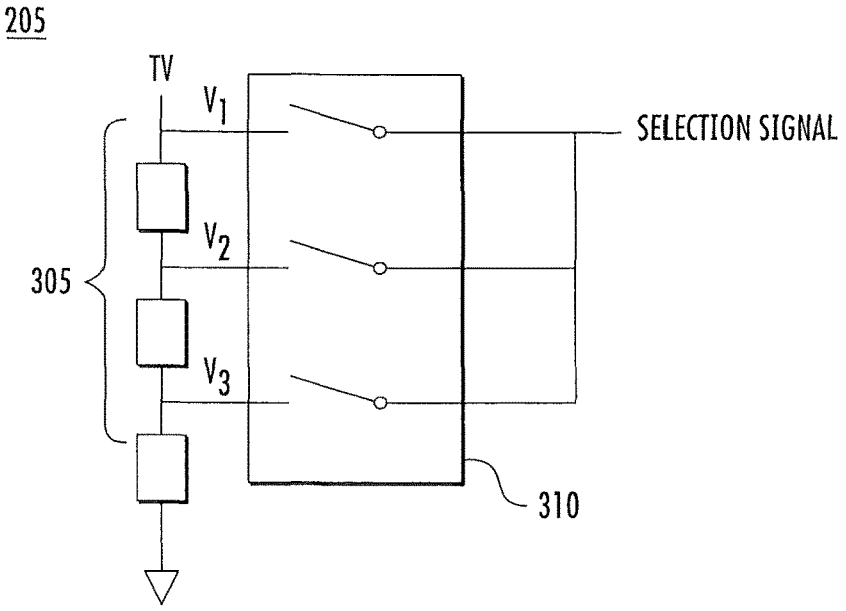
FIG. 3 is a block diagram illustrating a solid state lighting characteristic selection circuit included in the solid state lighting apparatus in some embodiments according to the invention.

FIG. 3 is a block diagram that illustrates the component circuits 205 illustrated in FIG. 2 in some embodiments according to the invention. According to FIG. 3, the selection signal can be provided by a network 305 of passive components coupled in series with one another to a voltage V. The voltage across each of the passive components in the network 305 can provide a different value that the selection signal can be assigned. During installation, for example, the appropriate value of the selection signal can be selected by a series of switches 310 coupled across the network 305 whereupon one of the switches corresponding to the selected value of the selection signal is closed so that the voltage is provided to the controller circuit 110, whereas the remaining switches are left open. In other embodiments according to the invention, other ones of the switches are closed to provide a different value for the selection signal so that a different one of the predefined solid state lighting models can be selected for operation by the controller circuit 110. It will be understood that in some embodiments according to the invention, the network 305 can include any type of passive component such as resistors, capacitors, inductors or combinations thereof.

Figure 4:
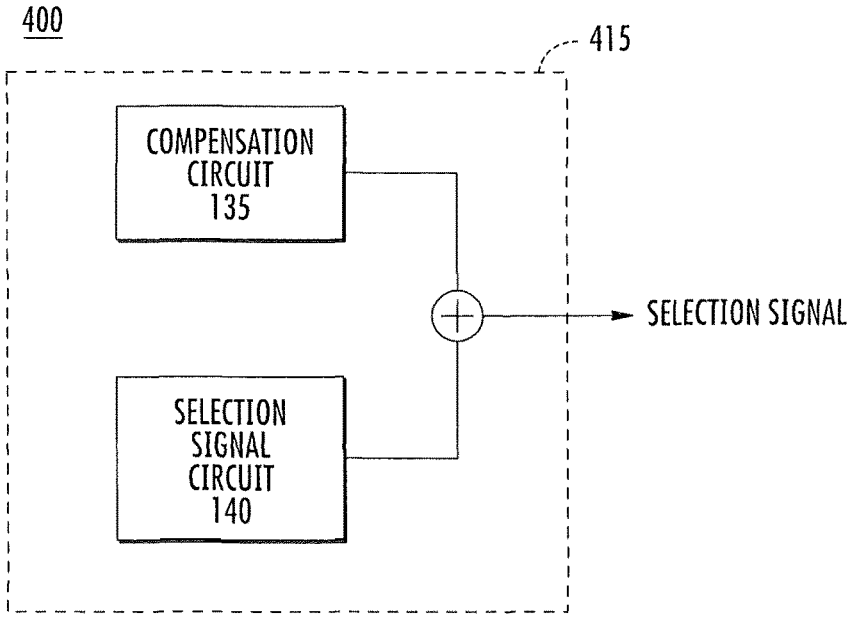
FIG. 4 is a block diagram illustrating a circuit configured to provide a combined signal including a solid state lighting characteristic selection component and a compensation component in some embodiments according to the invention.

FIG. 4 is a block diagram illustrating a solid state lighting characteristic selection circuit 405 including aspects of the compensation circuit 135 combined with those of the solid state lighting characteristic selection circuit 140. Accordingly, the combined signal can include components of the selection signal as well as the compensation signal combined with one another provided to a single input of the controller circuit 110, which may separate the components from the combined signal so that both the compensation signal and the selection signal may be provided for operation of the controller circuit 110. In some embodiments according to the invention, the combination of the components can be provided by time or frequency multiplexing the components together. In some embodiments according to the invention, the combination of the components can be added together to provide a composite signal that includes both components.

Figure 5:
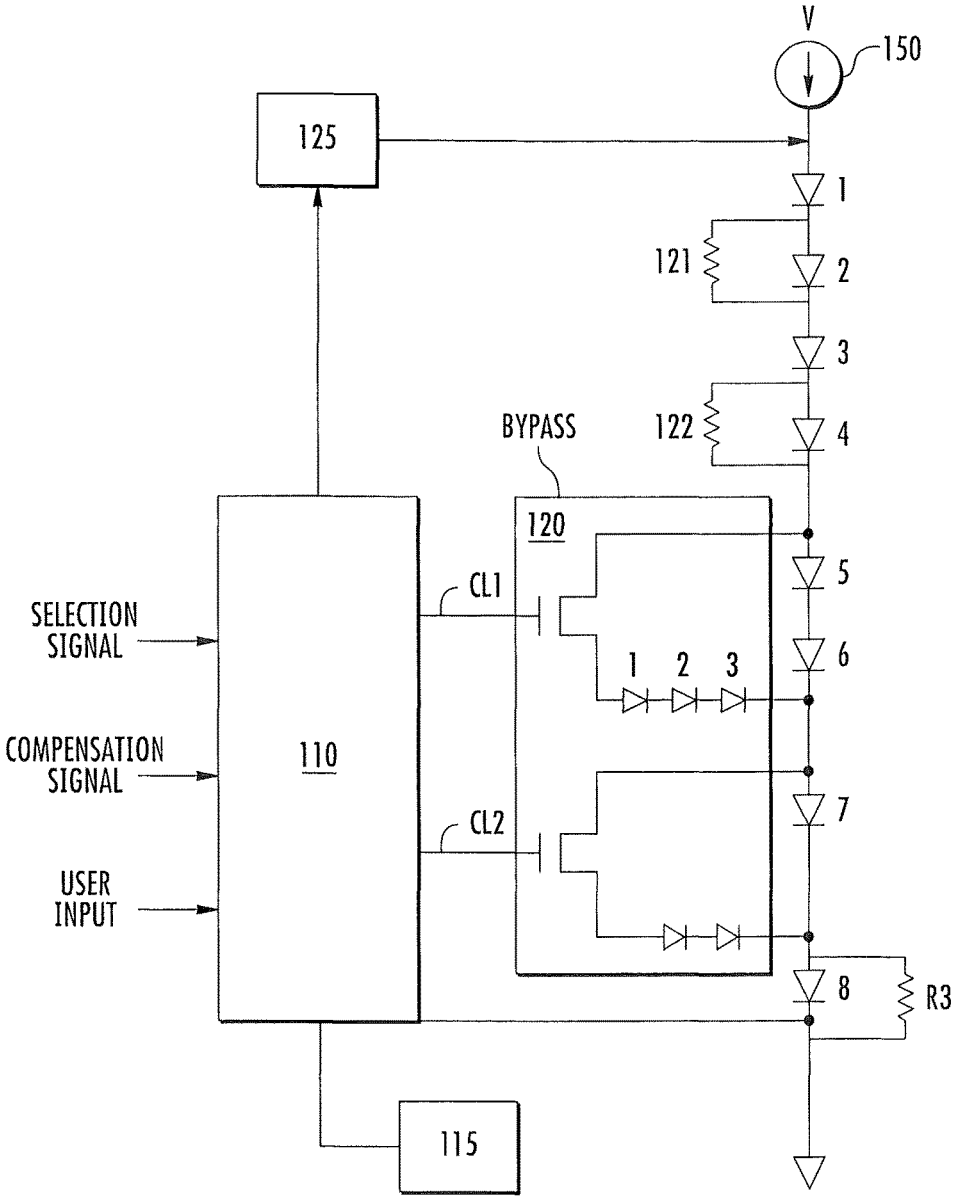
FIG. 5 is a schematic diagram illustrating a solid state lighting apparatus in some embodiments according to the invention.

FIG. 5 is a block diagram that illustrates the lighting apparatus 111 of FIG. 1 in further detail in some embodiments according to the invention. According to FIG. 5, the selection signal, compensation signal, and user input can be provided to the controller circuit 110 as described above. The current source control circuit 125 can operate responsive to the controller circuit 110 to control the current provided by the current source circuit 150 as described above in reference to FIG. 1. Still further, the controller circuit 110 can provide the duty cycle signals CL1 and CL2 to the bypass circuit 120 as described in reference to FIG. 1.

FIG. 5 further illustrates a more detailed view of the LED string 145 and exemplary components within the bypass circuit 120 in some embodiments according to the invention. Embodiments according to the present invention can utilize bypass compensation circuits (i.e., bypass circuits) as described in co-pending and commonly assigned U.S. patent application Ser. No. 12/566,195 entitled "Solid State Lighting Apparatus with Controllable Bypass Circuits and Methods of Operating Thereof" and co-pending and commonly assigned U.S. patent application Ser. No. 12/566,142 entitled "Solid State Lighting Apparatus with Configurable Shunts", the disclosures of which are incorporated herein by reference. It will be understood that the two circuits included in the bypass circuit 120 can be referred to separately as bypass circuits or collectively as a bypass circuit, when for example, two bypass circuits are used to control the color of the light emitted by the LED string 145.

The bypass circuits 120 may switch between LED(s), variably shunt around LED(s) and/or bypass LED(s) in the string 145 using the duty cycle signals provided by the controller circuit 110 in response to the user input and the selected predefined solid state lighting model. According to some embodiments, the output of the string 145 is modeled based on one or more variables, such as current, temperature and/or LED bins (brightness and/or color bins) used, and the level of bypass/shunting employed. The model may be adjusted for variations in individual lighting devices.

As shown in FIG. 5, the LED string 145 includes a plurality of LEDs (LED 1 through LED9) connected in series between a voltage source V and ground. The controller circuit 110 is coupled to the string 145 and control gates of transistors Q1 and Q2 via duty cycles signals CL1 and CL2.

The string 145 may include LEDs that emit different colors of light when current is passed through the string 145. For example, some of the LEDs may include phosphor coated LEDs that emit broad spectrum white, or near-white light when energized. Some of the LEDs may be configured to emit blue shifted yellow (BSY) light as disclosed, for example, in commonly assigned U.S. Pat. No. 7,213,940 issued May 8, 2007, entitled "Lighting Device And Lighting Method", and/or blue-shifted red (BSR) light as disclosed in U.S. application Ser. No. 12/425,855, filed Apr. 19, 2009, entitled "Methods for Combining Light Emitting Devices in a Package and Packages Including Combined Light Emitting Devices", or U.S. Pat. No. 7,821,194, issued Oct. 26, 2010, entitled "Solid State Lighting Devices Including Light Mixtures" the disclosures of which are incorporated herein by reference. Others of the LEDs may emit saturated or near-saturated narrow spectrum light, such as blue, green, amber, yellow or red light when energized. In further embodiments, the LEDs may be BSY, red and blue LEDs as described in co-pending and commonly assigned United States Patent Application Publication No. 2009/0184616, the disclosure of which is incorporated herein by reference, phosphor converted white or other combinations of LEDs, such as red-green-blue (RGB) and/or red-green-blue-white (RGBW) combinations. In one example, LED5 and LED6 may be red LEDs and LED7 may be a blue LED. The remaining LEDs may be BSY and/or red LEDs.

The LED string 145 includes subsets of LEDs that may be selectively bypassed by activation of transistors Q1 and Q2. For example, when transistor Q1 is switched on, LED5 and LED6 are bypassed, and non-light emitting diodes D1, D2 and D3 are switched into the string 145. Similarly, when transistor Q2 is switched on, LED7 is bypassed, and non-light emitting diodes D4 and D5 are switched into the string 145. Non-light emitting Diodes D1 through D5 are included so that variations in the overall string voltage are reduced when LED5, LED6 and LED7 are switched out of the string by transistors Q1 and Q2, The controller circuit 110 controls the duty cycles of the transistors Q1 and Q2 using duty cycle signals CL1 and CL2 based on the predefined solid state lighting model selected by the selection signal. In particular, the duty cycles of the transistors Q1 and Q2 may be controlled as described, for example, in U.S. application Ser. No. 12/968,789, entitled "LIGHTING APPARATUS USING A NON-LINEAR CURRENT SENSOR AND METHODS OF OPERATION THEREOF" filed Dec. 15, 2010, the disclosure of which is incorporated herein. The duty cycles of the transistors Q1 and Q2 may be controlled so that the total combined light output by the LED string 145 has the desired color.

Predictive models can be developed to provide the solid state lighting models described herein to allow tuning and operational control of the LEDs in the apparatus 111. In particular embodiments, a Bézier surface can be constructed based on the variables of lighting parameters (such as a color and intensity), temperature, current level (dimming indication) and shunt level associated with the duty cycle, These Bézier surfaces may then be used as a model to control the operation of the apparatus 111 having the same combination of LEDs as the reference set of LEDs.

A Bézier surface is a mathematical tool that can model a multidimensional function using a finite number of control points. In particular, a number of control points are selected that define a surface in an M-dimensional space. The surface is defined by the control points in a manner similar to interpolation. However, although the surface is defined by the control points, the surface does not necessarily pass through the control points. Rather, the surface is deformed towards the control points, with the amount of deformation being constrained by the other control points.

In some embodiments according to the invention, the Bézier surface can be defined to model a given M-dimensional space, where each of the M-dimensions corresponds to a particular parameter used to control operation of the lighting apparatus. For example, the M-dimensions can include parameters such as shunt level, ambient temperature, current, and the selection signal. It will be understood, however, that the number dimensions used can be arbitrary. In other words, even though the above example lists four dimensions, a Bézier surface can be define to model a space that has more (or less) dimensions. For example, if a new parameter, such as compensation, is to be considered in controlling the lighting apparatus, the compensation parameter can be added to define a new Bézier surface based on these five parameters as described herein.

A given Bézier surface of order (n, in) is defined by a set of (n+1)(m+1) control points $k_{i,j}$. A two-dimensional Bézier surface can be defined as a parametric surface where the position of a point p on the surface as a function of the parametric coordinates u, v is given by:

$$p(u, v) = \sum_{i=0}^{n} \sum_{j=0}^{m} B_i^n(u) B_j^m(v) k_{i,j}$$

where the Bézier function B is defined as $$B_i^n(u) = \binom{n}{i} u^i (1-u)^{n-i}$$

and $$\binom{n}{i} = \frac{n!}{i!(n-i)!}$$

is the binomial coefficient.

Examples of Bézier surfaces used to represent solid state lighting models to define relationships between lighting parameters, are illustrated in FIGS. 6 and 7. The Bézier surface 300 illustrated in FIG. 6 represents an LED shunt level (z-axis) associated with the duty cycle, plotted as a function of temperature (x-axis) and current (y-axis) of a solid state lighting apparatus 111, defined by sixteen control points 310, which are points in the three-dimensional space represented by the x-, y- and z-axes shown in FIG. 6.

The surface 300 represents a first solid state lighting model (selected by a first value for the selection signal) that defines a first relationship between the lighting parameters (e.g., intensity and color) used to vary light output from the solid state lighting apparatus responsive to a user input provided to the solid state lighting apparatus. The Bézier surface 300 provides a mathematically convenient model for a multidimensional relationship, such as modeling LED shunt level as a function of temperature and current for a given output color, because the Bézier surface is completely characterized by a finite number of control points (e.g. sixteen).

A five-axis model (u',v',T, I and S) can be collapsed based on the desired color point (u',v'), or color, to a three-axis model in which the shunt level (i.e., duty cycle) is determined as a function of current (I) used as the dimming indication, and temperature. That is, a three-axis model is constructed in which shunt level is dependent on current and selection signal value for a given color point selected by the user.

In some embodiments, a set of control points, which in some embodiments may include 16 control points, is established for the desired u',v' color indication, such that the shunt level or duty cycle of the a selected group of one or more controlled red LEDs required to achieve the desired (u',v') color indication, is a dependent variable based on temperature and current level. A corresponding family of sets of 16 control points is established for the desired u',v' color indication such that the shunt level of a group of one or more controlled blue LEDs required to achieve the desired (u',v') color indication is a dependent variable based on temperature and current level. These control points are then used by the controller circuit 110 to control the light output of the apparatus 111.

As further shown in FIG. 6, a surface 305 represents a second solid state lighting model (selected by a second value for the selection signal) that defines a second relationship between the lighting parameters used to vary light output from the solid state lighting apparatus responsive to a user input provided to the solid state lighting apparatus. Accordingly, when the selection signal has the first value, the surface 300 can be used by the controller circuit 110 to operate the apparatus 111, whereas when the selection signal has the second value, the surface 305 can be used by the controller circuit 110 to operate the apparatus 111.

Each of the Bézier surfaces 300, 305, therefore, represent a respective predefined solid state lighting model that defines the relationship between the different lighting parameters used to vary light output from the LED string 145 responsive to user input to the controller circuit 110. One or the other of the models can be selected based on the value of the selection signal. It will be understood that more than two models may be used. Moreover, as described above, the selection signal can be considered to be an additional dimension (as part of the M-dimensional space) to be modeled by the Bézier surface.

It will be further understood that although the Bézier surfaces 300, 305 are shown as discrete from one another and separated by a particular value for the selection signal, the Bézier surfaces 300, 305 may be relatively close to one another within the space show. Moreover, in some embodiments according to the invention, the Bézier surfaces 300, 305 can be close enough to one another that they represent a substantially continuous range of Bézier surfaces that can be accessed. In other words, the Bézier surfaces 300, 305 can be close enough to one another so that the user may perceive the change in operation in switching from one the Bézier surfaces to another as essentially continuous so that no appreciable discontinuity is observed in the operation of the lighting apparatus.

FIG. 7 illustrates a single Bézier surface representing a solid state lighting model defining a relationship between different lighting parameters used to vary light output from the apparatus 111 responsive to user input according to some embodiments according to the invention. According to FIG. 7, the particular value of the selection signal can select a two-dimensional slice of the surface 306 in the x-axis and y-axis directions. In particular, the selected slice of the surface 306 represents a curve relating to current and duty cycle (i.e., shunt level) that can be used as circuit parameter values to operate the apparatus 111. Accordingly, each of the different values of the selection signal along the x-axis can represent a different one of the predefined solid state lighting models supported by the controller circuit 110.

In operation, the value of the selection signal specifies the particular portion of the surface used to generate the circuit parameter values, such as the current generated by the current source circuit 105 and the duty cycle signals CL1 and CL2 provided to the bypass circuit 120 so that the light emitted by the LED string 145 is in accordance with the lighting parameters (such as dimming and color values) in response to the user input received by the controller circuit 110. The use of Bézier surfaces in controlling operations of lighting fixtures is described further in commonly assigned U.S. patent application Ser. No. 12/987,485, filed on Jan. 10, 2011, entitled SYSTEMS AND METHODS FOR CONTROLLING SOLID STATE LIGHTING DEVICES AND LIGHTING APPARATUS INCORPORATING SUCH SYSTEMS AND/OR METHODS, the disclosure of which is hereby incorporated herein by reference in its entirelty.

As described herein, a solid lighting characteristic selection signal can be used to select a solid state lighting model defining a relationship between different lighting parameters used to vary light output from the solid state lighting apparatus responsive to a user input to the apparatus. For example, in some embodiments according to the invention, the solid lighting characteristic selection signal (sometimes referred to herein a the selection signal) has a value corresponding to a model that controls the color of light provided by the apparatus to follow the plankian locus as the intensity of the light varies (sometimes referred to incandescent style dimming).

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A method of controlling a solid state lighting apparatus, the method comprising:

receiving a solid state lighting characteristic selection signal at a solid state lighting apparatus; and selecting, responsive to the solid state lighting characteristic selection signal, a solid state lighting model defining a relationship between at least two different lighting parameters used to vary light output from the solid state lighting apparatus responsive to a user input provided to the solid state lighting apparatus.

2. The method of claim 1 wherein receiving a solid state lighting characteristic selection signal at a solid state lighting apparatus comprises receiving the solid state lighting characteristic selection signal at the solid state lighting apparatus separate from the user input.

3. The method of claim 2 wherein the user input comprises user input from a solid state lighting switch.

4. The method of claim 3 wherein the user input comprises a dimming indication configured to control dimming of the light output from the solid state lighting apparatus.

5. The method of claim 1 wherein selecting a solid state lighting model comprises selecting among a plurality of predefined solid state lighting models each corresponding to a respective value of the solid state lighting characteristic selection signal.

6. The method of claim 5 wherein the plurality of predefined solid state lighting models are configured to vary the light output from the solid state lighting apparatus differently in response to identical user input to the solid state lighting apparatus.

7. The method of claim 1 further comprising:

receiving a compensation signal, at the solid state lighting apparatus, configured to reduce variation in the light output from the solid state lighting apparatus associated with variation in light emitted from different light emitting diodes included in the solid state lighting apparatus.

8. The method of claim 7 further comprising:

receiving the compensation signal at the solid state lighting apparatus separately from the solid state lighting characteristic selection signal.

9. The method of claim 7 wherein receiving a compensation signal at the solid state lighting apparatus comprises receiving a combined signal including the compensation signal and the solid state lighting characteristic selection signal at solid state lighting apparatus.

10. The method of claim 1 wherein receiving a solid state lighting characteristic selection signal at a solid state lighting apparatus comprises receiving the solid state lighting characteristic selection signal from a circuit that is local to the apparatus and is configured during, or prior to, installation of the solid state lighting apparatus.

11. The method of claim 1 wherein receiving a solid state lighting characteristic selection signal at a solid state lighting apparatus comprises receiving the solid state lighting characteristic selection signal from a circuit that is outside the apparatus and is configured to provide the solid state lighting characteristic selection signal during operation of the solid state lighting apparatus.

12. The method of claim 1 wherein the solid state lighting model comprises a first solid state lighting model, the solid state lighting characteristic selection signal comprises a first value, and the relationship comprises a first relationship the method further comprising:

selecting, responsive to the solid state lighting characteristic selection signal having a second value, a second solid state lighting model defining a second relationship between the at least two different lighting parameters used to vary the light output from the solid state lighting apparatus responsive to the user input provided to the solid state lighting apparatus.

13. The method of claim 12 wherein a first lighting parameter of the solid state lighting apparatus comprises dimming value and a second lighting parameter of the solid state lighting apparatus comprises a color value.

14. The method of claim 13 wherein the color value comprises a correlated color temperature value, a color registration index value, a color point value, or a chromaticity value.

15. The method of claim 13 wherein a third lighting parameter of the solid state lighting apparatus comprises a temperature value.

16. The method of claim 1 further comprising:

providing circuit parameter values, based on the selected solid state lighting model, to provide the light output from the apparatus.

17. The method of claim 16 wherein the circuit parameter values comprise a duty cycle signal to control a shunt level of at least one light emitting diode included in a LED string of the apparatus and a current control signal configured to control current provided to the LED string.

18. The method of claim 17, wherein the solid state lighting model is approximated by a plurality of control points of a Bézier surface that provides the duty cycle signal responsive to the current.

19. The method of claim 1 wherein receiving a solid state lighting characteristic selection signal at a solid state lighting apparatus comprises receiving the solid state lighting characteristic selection signal from a circuit including a resistor, a capacitor, and/or an inductor.

20. A solid state lighting apparatus comprising:

a light emitting diode (LED) string including a plurality of LEDs, the LED string configured to emit light responsive to current provided to the LEDs;

a solid state lighting characteristic selection circuit configured to provide a solid state lighting characteristic selection signal; and a solid state lighting controller circuit, coupled to the LED string and to the solid state lighting characteristic selection circuit, configured to select a solid state lighting model responsive to the solid state lighting characteristic selection signal input to the controller circuit, the model configured to define a relationship between at least two different lighting parameters used to vary the light emitted from the LED string responsive to a user input to the controller circuit.

21. The apparatus of claim 20 wherein the solid state lighting controller circuit further comprises:

a solid state lighting characteristic selection input, coupled to the solid state lighting characteristic selection signal, wherein the solid state lighting characteristic selection input is separate from the user input to the solid state lighting controller circuit.

22. The apparatus of claim 21 wherein the user input is configured for coupling to a solid state lighting switch remote from the apparatus.

23. The apparatus of claim 21 wherein the user input comprises a dimming indication input configured to control dimming of the light output from the solid state lighting apparatus.

24. The apparatus of claim 20 wherein the solid state lighting characteristic selection circuit comprises at least one passive component configured to provide the solid state lighting characteristic selection signal.

25. The apparatus of claim 24 wherein the at least one passive component comprises a resistor, a capacitor, and/or an inductor.

26. The apparatus of claim 20 wherein the solid state lighting controller circuit is further configured to select among a plurality of predefined solid state lighting models each corresponding to a respective value of the solid state lighting characteristic selection signal.

27. The apparatus of claim 26 wherein the plurality of predefined solid state lighting models are configured to vary the light emitted from the LED string differently in response to identical user input to the solid state lighting apparatus.

28. The apparatus of claim 20 further comprising:

a compensation circuit, coupled to the controller circuit and separate from the solid state lighting characteristic selection circuit, configured to provide a compensation signal to reduce variation in the light emitted from the LED string associated with variation in light emitted from different LEDs included in the LED string based on identical user input.

29. The apparatus of claim 20 wherein the solid state lighting characteristic selection circuit is further configured to provide a combined signal including a compensation signal and the solid state lighting characteristic selection signal, wherein the compensation signal is configured to reduce variation in the light emitted from the LED string associated with variation in light emitted from different LEDs included in the LED string.

30. The apparatus of claim 20 wherein the solid state lighting characteristic selection circuit is local to the apparatus and is configured during, or prior to, installation of the solid state lighting apparatus.

31. The apparatus of claim 20 wherein a portion of the solid state lighting characteristic selection circuit is outside the apparatus and is configured to provide the solid state lighting characteristic selection signal during operation of the solid state lighting apparatus.

32. The apparatus of claim 20 wherein the solid state lighting model comprises a first solid state lighting model, the solid state lighting characteristic selection signal comprises a first value, and the relationship comprises a first relationship, the controller circuit is further configured to select, responsive to the solid state lighting characteristic selection signal having a second value, a second solid state lighting model defining a second relationship between the at least two different lighting parameters used to vary the light emitted from the LED string responsive to the user input provided to the solid state lighting apparatus.

33. The apparatus of claim 32 wherein a first lighting parameter of the solid state lighting apparatus comprises dimming value and a second lighting parameter of the solid state lighting apparatus comprises a color value.

34. The apparatus of claim 33 wherein the color value comprises a correlated color temperature value, a color registration index value, a color point value, or a chromaticity value.

35. The apparatus of claim 33 wherein a third lighting parameter of the solid state lighting apparatus comprises a temperature value.

36. The apparatus of claim 20 wherein the controller circuit is further configured to provide circuit parameter values, based on the selected solid state lighting model, to provide the light emitted from the LED string.

37. The apparatus of claim 36 wherein the circuit parameter values comprise a duty cycle signal and a current source control signal, the apparatus further comprising:

a bypass circuit, coupled to the controller circuit and to the LED string, configured to by-pass at least one of the plurality of LEDs responsive to the duty cycle signal; and a current source control circuit, coupled to the LED string and to the controller circuit, configured to control the current provided to the LED string.

38. The apparatus of claim 37, wherein the solid state lighting model is approximated by a plurality of control points of a Bézier surface that provides the duty cycle signal responsive to the current source control signal.

39. A method of controlling a solid state lighting apparatus, the method comprising:

receiving a solid state lighting characteristic selection signal at a solid state lighting apparatus;

selecting, responsive to the solid state lighting characteristic selection signal, a solid state lighting model defining a relationship between different lighting parameters used to vary light output from the solid state lighting apparatus responsive to a user input provided to the solid state lighting apparatus; and providing circuit parameter values, based on the selected solid state lighting model, to provide the light output from the apparatus, wherein the circuit parameter values comprise a duty cycle signal to control a shunt level of at least one light emitting diode included in a LED string of the apparatus and a current control signal configured to control current provided to the LED string, wherein the solid state lighting model is approximated by a plurality of control points of a Bézier surface that provides the duty cycle signal responsive to the current.

40. A solid state lighting apparatus comprising:

a light emitting diode (LED) string including a plurality of LEDs, the LED string configured to emit light responsive to current provided to the LEDs;

a solid state lighting characteristic selection circuit configured to provide a solid state lighting characteristic selection signal; and a solid state lighting controller circuit, coupled to the LED string and to the solid state lighting characteristic selection circuit, configured to select a solid state lighting model responsive to the solid state lighting characteristic selection signal input to the controller circuit, the model configured to define a relationship between different lighting parameters used to vary the light emitted from the LED string responsive to a user input to the controller circuit;

wherein the solid state lighting controller circuit is further configured to provide circuit parameter values, based on the selected solid state lighting model, to provide the light emitted from the LED string;

wherein the circuit parameter values comprise a duty cycle signal and a current source control signal, the apparatus further comprising:

a bypass circuit, coupled to the controller circuit and to the LED string, configured to by-pass at least one of the plurality of LEDs responsive to the duty cycle signal;

a current source control circuit, coupled to the LED string and to the controller circuit, configured to control the current provided to the LED string;

wherein the solid state lighting model is approximated by a plurality of control points of a Bézier surface that provides the duty cycle signal responsive to the current source control signal.

* * * * *